US009972976B2

(12) United States Patent
Schmutz

(10) Patent No.: US 9,972,976 B2
(45) Date of Patent: May 15, 2018

(54) SURGE ARRESTER

(71) Applicant: Phoenix Contact GmbH & Co. KG, Blomberg (DE)

(72) Inventor: Jan-Erik Schmutz, Detmold (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 273 days.

(21) Appl. No.: 14/885,613

(22) Filed: Oct. 16, 2015

(65) Prior Publication Data

US 2016/0118775 A1 Apr. 28, 2016

(30) Foreign Application Priority Data

Oct. 23, 2014 (DE) ..... 10 2014 015 610

(51) Int. Cl.
*H01T 4/04* (2006.01)
*H01T 4/02* (2006.01)
*H01T 2/02* (2006.01)

(52) U.S. Cl.
CPC ..... *H01T 4/04* (2013.01); *H01T 2/02* (2013.01); *H01T 4/02* (2013.01)

(58) Field of Classification Search
CPC .... H01T 4/04; H01T 4/02; H01T 2/02; H02H 9/06
See application file for complete search history.

(56) References Cited

U.S. PATENT DOCUMENTS 3,710,178 A * 1/1973 Johnson ..... H01T 2/02 313/601
5,097,231 A * 3/1992 Johnson ..... H01J 17/066 313/309
5,146,141 A * 9/1992 Rohde ..... H01J 17/44 313/590
7,271,992 B2 * 9/2007 Wittmann ..... H01T 4/06 361/129

FOREIGN PATENT DOCUMENTS

DE 10140950 A1 * 2/2003 ..... H01T 4/12
DE 10338835 A1 3/2005

* cited by examiner

*Primary Examiner* — Scott Bauer
(74) *Attorney, Agent, or Firm* — David S. Safran

(57) ABSTRACT

A surge arrester for the power supply of low voltage systems with a housing, two main electrodes which form a spark gap, an arcing chamber within the housing between the two main electrodes and with an ignition aid. When the ignition aid operates in an ignition region, ionized gas is produced which spreads in the arcing chamber so that the spark gap ignites between the two main electrodes and an arc arises in the arcing chamber. The ignition of the spark gap between the two main electrodes occurs relatively quickly after the operation of the ignition aid so that the components of the ignition aid are stressed as little as possible and are protected against damage, and at least one feed channel is formed between the ignition aid and the arcing chamber by which ionized gas produced in the ignition region flows into the arcing chamber.

13 Claims, 5 Drawing Sheets

SURGE ARRESTER

BACKGROUND OF THE INVENTION

Field of the Invention

The invention relates to a surge arrester for use in the power supply of low voltage systems, with a housing, with two main electrodes which form a spark gap, with one arcing chamber which is made within the housing between the two main electrodes and with one ignition aid, when the ignition aid operates in one ignition region ionized gas is produced and spreads in the arcing chamber so that the spark gap ignites between the two main electrodes and an arc arises in the arcing chamber.

Description of Related Art

In low voltage systems, to protect against overvoltages, surge arresters based on spark gaps are often used, i.e. surge arresters whose important component is a spark gap which sparks over at a certain overvoltage, when the spark gap is ignited an arc forming between the two electrodes. Since surge arresters with spark gaps are also used to protect against a lightning strike, very high and steeply rising currents with values into the three-place kA range flow via the spark gap. Due to the pressures which arise within the surge arrester, these surge arresters are generally located in pressure-tight housings which often consist of metal, in particular of steel.

Surge arresters with a spark gap as the arrester do have the advantage of a high surge current carrying capacity, but also the disadvantage of a relatively high and also not especially constant sparkover voltage. Therefore, to ignite spark gaps, for a long time different types of ignition aids have been used, using which the sparkover voltage of the spark gap or of the surge arrester is reduced. Often ignition aids are used here which have at least one ignition electrode which is connected via an external circuit to a potential which differs from the potentials on the two main electrodes.

German Patent Application DE 103 38 835 A1 discloses an initially described surge arrester in which the distance between the two electrodes is chosen to be so great that the arc voltage is greater than the expected line voltage. This prevents the occurrence of a line follow current. So that the sparkover voltage of this surge arrester due to the relatively great distance of the two electrodes of the spark gap is not too large, there is an ignition aid by which the desired sparkover voltage of the surge arrester can be set.

In the known surge arrester the ignition aid in addition to the ignition electrode has an ignition element and a voltage switching element, the ignition electrode and the ignition element being located within the metallic housing and being in direct contact with the arcing chamber. When an overvoltage occurs, which is greater that the operating voltage of the voltage switching element, first, a current flows from the first terminal of the surge arrester via the voltage switching element and the housing to the ignition electrode. Since the resistive ignition element on one side touches the ignition electrode and on the other side the assigned main electrode, the current flows from the ignition electrode via the ignition element to the assigned main electrode.

The current flow via the ignition element in doing so leads to a discharge on the surface of the ignition element and an initial arc between the ignition electrode and the main electrode which is assigned to the ignition element so that in the ignition region bordering the ignition element ionized gas is produced which then spreads in the direction of the opposing main electrode. If the arcing chamber is sufficiently filled with ionized gas, as a result of which the breakdown voltage between the two main electrodes is reduced, ignition of the spark gap between the main electrodes occurs. The surge current which is to be diverted is then no longer diverted via the components of the ignition aid, but via the arc which has formed between the two main electrodes. The longer it takes for the spark gap to be ignited, the more current flows via the ignition aid so that the components of the ignition aid, in particular the ignition circuit with the voltage switching element, must be designed to be accordingly durable to avoid damage. Since the time interval until the arcing chamber is sufficiently filled with ionized gas also depends on the distance of the two main electrodes from one another, the distance between the main electrodes would have to be chosen to be as small as possible; but this would have an adverse effect on the line follow current extinguishing capacity of the surge arrester.

SUMMARY OF THE INVENTION

Therefore, the primary object of this invention is to develop the initially described surge arrester such that ignition of the spark gap between the two main electrodes occurs as quickly as possible after the operation of the ignition aid so that the components of the ignition aid are stressed as little as possible and are protected against damage.

This object is achieved in the initially described surge arrester in that, between the ignition aid and the arcing chamber, at least one feed channel is formed by which ionized gas produced in the ignition region flows into the arcing chamber. The ignition aid is thus located not directly bordering the arcing chamber, but spaced apart from the arcing chamber, between the ignition aid and arcing chamber there being a connection due to the formation of the at least one feed channel. Via this connection, ionized gas which has been produced in the ignition region is routed into the arcing chamber so that the ionized gas reduces the breakdown voltage between the two main electrodes and ignition of the spark gap occurs. The feed channel is made and arranged such that the ionized gas which has been produced in the ignition region spreads with a velocity as high as possible in one defined direction, specifically in the direction of the arcing chamber. This results in that within a relatively short time after the operation of the ignition aid the ignition of the spark gap between the two main electrodes occurs, as a result of which the current which is flowing via the ignition aid, and thus, also the load on the ignition aid can also be reduced.

The formation of at least one feed channel between the ignition aid and the arcing chamber moreover has the advantage that the ignition aid is not, as in the prior art, in direct contact with the arcing chamber so that the ignition aid or its components which are connected to the feed channel are protected in the arcing chamber against the hot gas which forms when an arc is pending between the two main electrodes. In this way the thennal burden on the components of the ignition aid which border the ignition region is reduced.

The ignition aid, by which ionized gas is produced in the ignition region upon operation and is used for pre-ionization of the arcing chamber, could have an ignition electrode which together with the adjacent main electrode forms an ignition spark gap. In addition to the ignition electrode which is then located at a short distance to the assigned main electrode, the ignition aid as is known for itself from the prior art, could have an ignition circuit with a voltage switching element, the ignition circuit with the voltage switching element providing for operation of the ignition spark gap when there is a corresponding overvoltage on the surge arrester and on the voltage switching element.

According to one advantageous configuration of the surge arrester as claimed in the invention, the ignition aid however in addition to an ignition circuit has at least one resistive ignition element, the ignition element being connected to the feed channel and on one side being electrically connected via the ignition circuit to the first main electrode and on the other side touching the second main electrode. After ignition of the ignition circuit, a current then flows from the first main electrode or the first terminal of the surge arrester connected to the first main electrode via the ignition element to the second main electrode. Due to the low current carrying capacity of at least the surface of the ignition element, which surface is connected to the feed channel, current flow via the ignition element leads to discharges; this leads to ionization of the ignition region bordering the ignition element. Then the ionized gas travels in a controlled manner into the arcing chamber through the connection of the ignition region via the feed channel to the arcing chamber so that ignition of the spark gap between the two main electrodes occurs when the arcing chamber is sufficiently filled with ionized gas.

Preferably, the above described ignition aid has an ignition electrode which is electrically connected on one side to the ignition circuit and on the other side touches the ignition element. The ignition element is then located between the second main electrode and the ignition electrode. The arrangement of the ignition electrode on the side of the ignition element opposite the second main electrode leads to the above described discharges on the ignition element occurring in a controlled manner on the surface of the ignition element which is connected to the feed channel. By its fundamental structure and its manner of operation the ignition aid can thus be made like the ignition aid is made as is described in the above mentioned German Patent Application DE 103 38 835 A1.

It was stated above that the feed channel is made such that the ionized gas which has been produced in the ignition region is routed into the arcing chamber with a speed as high as possibility. This can first of all be achieved by the feed channel having a relatively small diameter which is at least smaller than the diameter of the arcing chamber between the two main electrodes. In terms of flow engineering the feed channel can also be made optimized by its having no corners and edges so that reflections of the flowing gas are avoided. Likewise, with respect to the flow properties it is positive if the feed channel has a circular cross section at each location.

According to one advantageous configuration of the surge arrester as claimed in the invention the feed channel is made at least in sections as a nozzle, as a result of which the flow velocity is increased. In particular the feed channel can be made in the manner of a Laval nozzle or a Venturi nozzle. The feed channel is made as smooth-walled as possible and has an initially convergent and then divergent cross section.

In order to achieve a distribution of the generated ionized gas as prompt and uniform as possible in the arcing chamber, the discharge of the feed channel takes place preferably in a middle region of the arcing chamber. Alternatively or in addition, several feed channels can be made which discharge in different regions of the arcing chamber; this likewise leads to the ionized gas which has been produced in the ignition region being distributed as promptly and uniformly as possible in the arcing chamber so that prompt ignition of the spark gap between the two main electrodes occurs. When there are several feed channels, for example, one feed channel at a time in the vicinity of the main electrode can discharge into the arcing chamber so that the ionized gas spreads at the same time from the two main electrodes in the direction of the middle of the arcing chamber.

According to another advantageous configuration of the surge arrester as claimed in the invention, the two main electrodes are arranged concentrically to one another such that one main electrode surrounds the other main electrode at least in the region of the arcing chamber with a radial distance. One main electrode, the inner one, can for example be made rod-shaped while the other, outer main electrode is made pot-shaped or cup-shaped. This configuration and arrangement of the two main electrodes to one another makes it possible for the arcing chamber to have several sections which are parallel to one another and which each extend between the two main electrodes, the individual sections being connected to one another bordering the two main electrodes via axially extending channels. This reduces the volume of the arcing chamber; this leads to more rapid ignition of the spark gap without the distance between the two main electrodes having to be reduced.

According to one preferred version of the configuration which was described last, the section of the arcing chamber into which the feed channel discharges has a smaller volume than the other sections of the arcing chamber. In this way the volume of the arcing space which must be ionized for initial ignition between the two main electrodes can be further reduced without the total volume of the arcing chamber becoming altogether too small. If the pressure within the arcing chamber becomes too great, this has specifically adverse effects both on the line follow current extinguishing capacity and also on the structural demands on the housing and the material of the insulation surrounding the arcing chamber.

According to one last advantageous configuration of the surge arrester as claimed in the invention which will be briefly described here, on the side of the arcing chamber facing away from the feed channel at least one outflow channel is formed via which ionized gas can flow out of the arcing chamber. In this way both an overly high pressure rise within the arcing chamber can be prevented and also deionization of the arcing chamber after diversion of a surge current can be achieved, as a result of which re-ignition of the spark gap can be prevented. Preferably the at least one outflow channel is routed along the first main electrode so that the hot gases flowing out of the arcing chamber can be optimally cooled by the large metal surface of the main electrode.

In particular, at this point, there is a host of possibilities for configuring and developing the surge arrester of the invention as will be apparent from the following description of preferred exemplary embodiments in conjunction with the accompanying drawings.

DETAILED DESCRIPTION OF THE INVENTION

Figure 1:
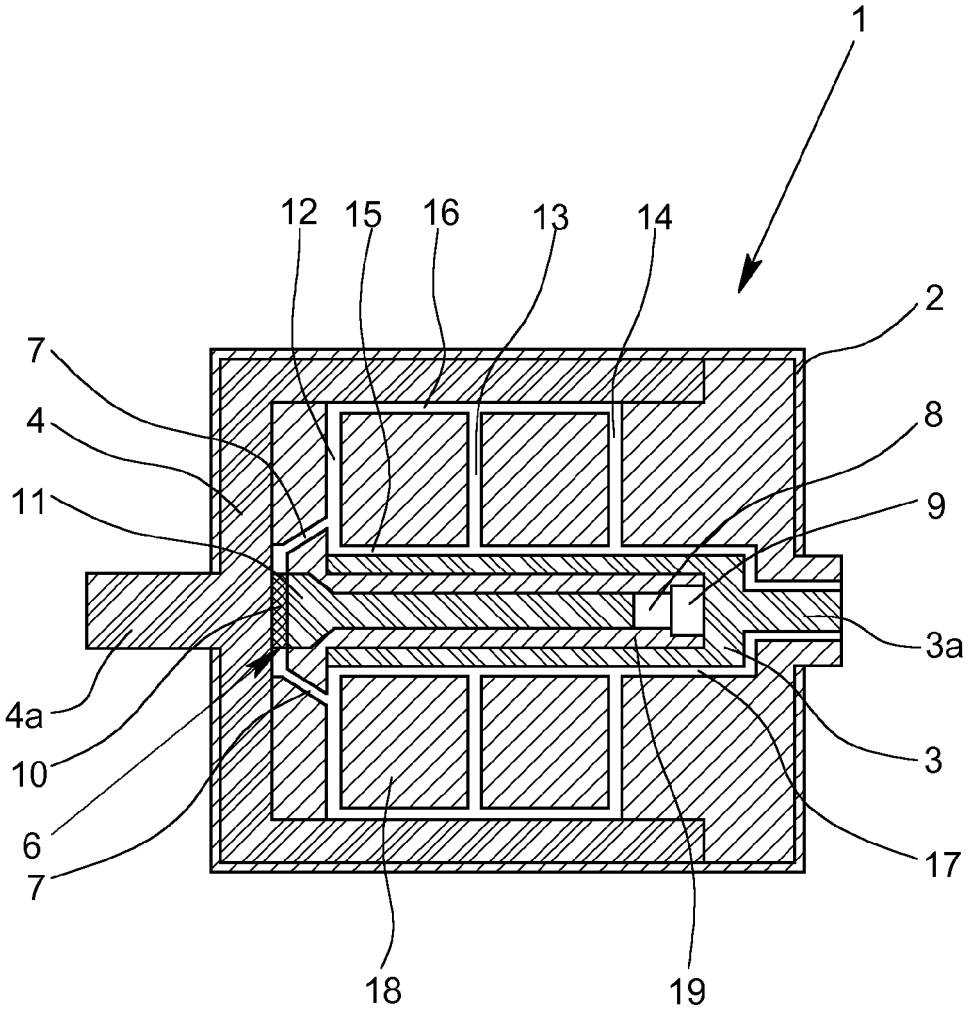
FIG. 1 shows a simplified schematic of a first exemplary embodiment of a surge arrester.

The figures show simplified, partially very schematic representations of different versions of the surge arrester 1 as claimed in the invention, the surge arrester 1 having a housing 2 with two main electrodes 3 and 4 which form a spark gap and between which an arcing chamber 5 is formed within the housing 2. The connection regions 3*a*, 4*a* of the two main electrodes 3, 4 are routed as terminals out of the housing 2 so that the surge arrester 1 can be electrically connected to one phase L and the neutral lead N of a low voltage system.

In addition to the main electrodes 3, 4, the surge arrester 1 has an ignition aid with which the sparkover voltage of the surge arrester 1 can be fixed or set. The ignition aid provides for the surge arrester 1 sparking over in an overvoltage surge which is much smaller than the sparkover voltage of the spark gap between the two main electrodes 3, 4. When the ignition aid operates, in an ignition region 6 which borders the ignition aid ionized gas is produced which is used for pre-ionization of the arcing chamber 5, as a result of which the breakdown voltage between the two main electrodes 3, 4 in the arcing chamber 5 is reduced. In the surge arrester 1 as claimed in the invention, between the ignition aid and the arcing chamber 5 at least one feed channel 7 is formed by which ionized gas which has been produced in the ignition region 6 when the ignition aid operates is routed in a controlled manner and with a velocity as high as possible into the arcing chamber 5.

In the exemplary embodiments of the surge arrester 1 which are shown in the figures, the ignition aid has an ignition circuit which is formed by the series circuit of a gas-filled surge arrester 8 and a varistor 9. Moreover, the ignition aid includes a resistive ignition element 10 and an ignition electrode 11, at least the ignition element 10 being connected to the feed channel 7. The ignition element 10 on one side makes contact with the ignition electrode 11 and on the other side with the assigned second main electrode 4. Moreover the ignition electrode 11 is electrically connected to the first main electrode 3 and the connection region 3*a* via the series circuit of a gas-filled surge arrester 8 and a varistor 9. The leads to the fact that after ignition of the ignition circuit, first a current flows from the ignition electrode 11 via the ignition element 10 to the second main electrode 4. Because at least the surface of the ignition element 10 which is connected to the feed channel 7 has only a relatively low current carrying capacity, the current flow via the ignition element 10 leads to discharges so that ionized gas is produced in the ignition region 6. This ionized gas which has been produced in the ignition region 6 now flows as claimed in the invention through the feed channel 7 into the arcing chamber 5 where then ignition of the spark gap occurs between the two main electrodes 3, 4.

The different configurations of the feed channel 7 which are shown in the individual figures results in that the ionized gas flows with a velocity as high as possible out of the ignition region 6 in a controlled manner into the arcing chamber 5 so that the arcing chamber 5 is filled relatively quickly with sufficiently ionized gas so that the spark gap ignites between the two main electrodes 3, 4 and an arc arises in the arcing chamber 5. The surge current which is to be diverted then flows via the arc and no longer via the ignition aid so that the components of the ignition aid are no longer loaded by the surge current. This leads to lower loading of the components of the ignition aid so that they need only be designed for lower loads. In this way, the components of ignition circuit, i.e. the gas-filled surge arrester 8 and the varistor 9, have relatively small dimensions so that there is the possibility of arranging the gas-filled surge arrester 8 and the varistor 9 in a bore made in the first main electrode 3, as is shown in the two exemplary embodiments according to FIGS. 1 and 3.

Forming a feed channel 7 between the ignition region 6, which borders the ignition element 10, and the arcing chamber 5 moreover leads to the ignition element 10 indirectly bordering the arcing chamber 5. In this way, the ignition element 10 is not exposed to the especially hot gases which form when there is an arc in the arcing chamber 5 so that the thermal loading of ignition element 10 is reduced.

Figure 2:
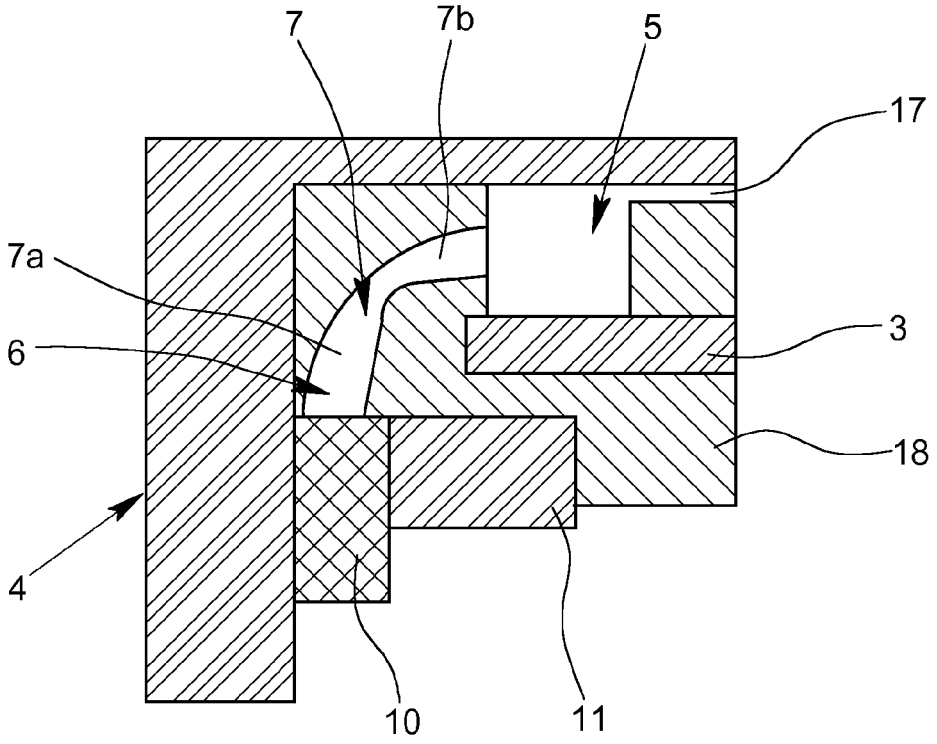
FIG. 2 shows a detailed representation of the surge arrester according to the invention.

In the detailed representation of the surge arrester 1 shown in FIG. 2, it can be recognized that the feed channel 7 does not have any corners and edges, as a result of which the flow of the ionized gas from the ignition region 6 into the arcing chamber 5 is not hindered since reflections on such corners and edges are avoided. The feed channel 7 which is shown in FIG. 2 is made in the manner of a Laval nozzle so that it has a convergent cross section 7*a* which is first in the flow direction and a subsequent divergent cross section 7*b*. This can greatly accelerate the ionized gas which is flowing through the feed channel 7, and compression shocks can be avoided when the cross sectional areas are circular at each site of the feed channel 7.

Figure 3:
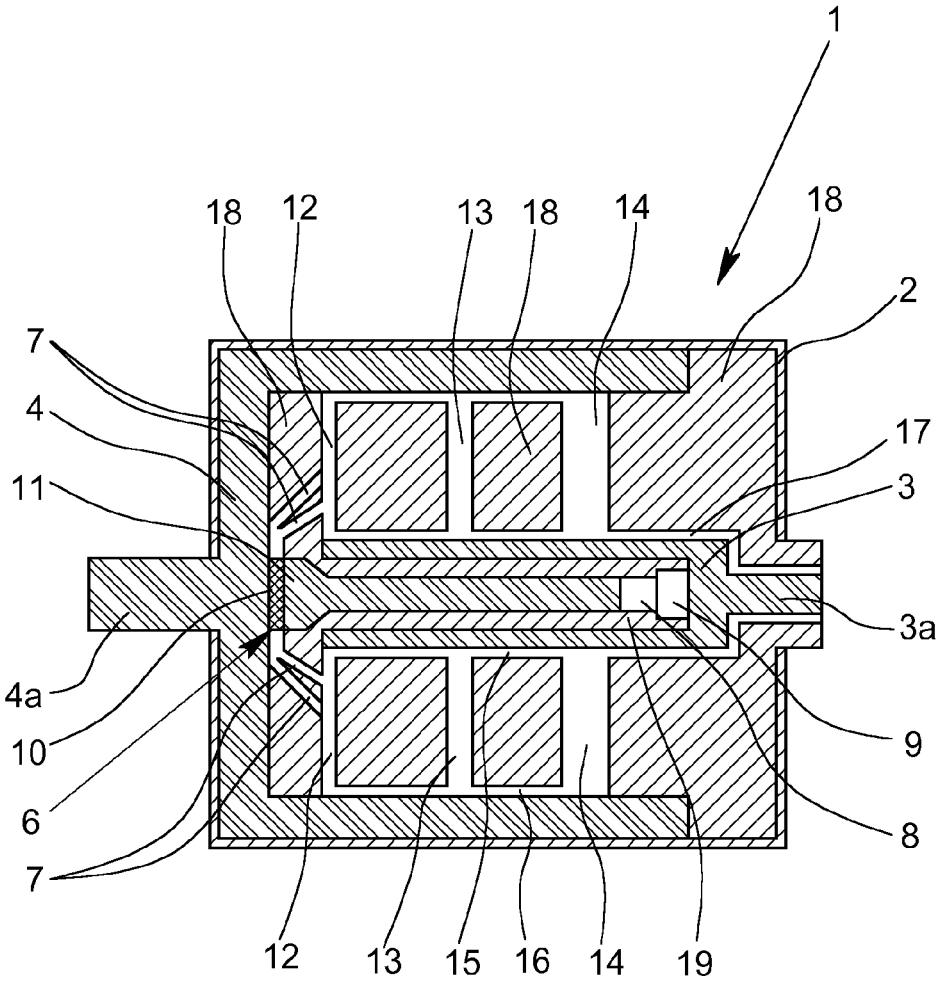
FIG. 3 shows a simplified representation of one version of the surge arrester according to the invention.

The exemplary embodiment of the surge arrester 1 according to FIG. 3 differs, first of all, from the exemplary embodiment according to FIG. 1 in that there is twice the number of feed channels 7. The individual feed channels 7 discharge into different regions of the arcing chamber 5, as a result of which the ionized gas is distributed more uniformly in the arcing chamber 5; this further shortens the time until ignition of the spark gap. It is common to the two exemplary embodiments of the surge arrester 1, as shown in FIGS. 1 and 3, that the two main electrodes 3, 4 are arranged concentrically to one another so that the first main electrode 3 is located within the second main electrode 4 and the second main electrode 4 at least in the region of the arcing chamber 5 surrounds the first main electrode 3 with a radial distance.

As can be recognized from the figures, the arcing chamber 5 has several, specifically in this case three, sections 12, 13, 14 which are parallel to one another and which extend radially between the two main electrodes 3, 4. The individual sections 12, 13, 14 are connected to one another via channels 15, 16 which extend axially bordering the two main electrodes 3, 4 so that the sections 12, 13, 14 and the channels 15, 16 together form a common arcing chamber 5. The total cross sectional area of the arcing chamber 5 is subdivided in this way into the individual parallel sections 12, 13, 14, according to the exemplary embodiment shown in FIG. 3 the section 12 of the arcing chamber 5 into which the feed channels 7 discharge having a smaller volume, i.e. a smaller cross section, than the other sections 13, 14. In this way, first ignition of the spark gap occurs in a controlled manner and after a very short time within the section 12 so that the surge current which is to be diverted then no longer flows via the ignition aid, but via the arc which has formed between the two main electrodes 3, 4.

In addition to the feed channel 7 which connects the ignition region 6 to the arcing chamber 5, the surge arrester 1 has an outflow channel 17 which can be used for deionization of the arcing chamber 5 after the diversion process.

The outflow channel 17 is routed along the first main electrode 3 so that the ionized gas is routed past the metal surface of the main electrode 3, as a result of which optimum cooling of the gases emerging from the arcing chamber 5 is achieved.

To form the individual, above described channels, within the housing 2 there is insulation 18 which is used also for insulation between the two main electrodes 3, 4. The insulation 18 can consist of a single insulation body into which the individual channels are placed or are implemented by several insulation bodies between which then at least in part the channels can be formed. For insulation between the main electrode 3 and the ignition electrode 11 moreover within the bore in the main electrode 3 there is a further insulation body 19 which is also used for positioning of the ignition electrode 11 within the main electrode 3.

At least the insulation body in which the feed channel 7 is formed consists preferably of a hard-gassing material, for example of POM, or of a non-gassing material, for example ceramic or a fiber cement material. The feed channel 7 is then surrounded by a hard-gassing material or a non-gassing material. Alternatively the feed channel 7 can also be surrounded in sections by a gassing and a non-gassing material. At least in this case the feed channel is surrounded preferably by several insulation bodies, of which at least one consists of a gassing and at least one of a non-gassing material.

Figure 4:
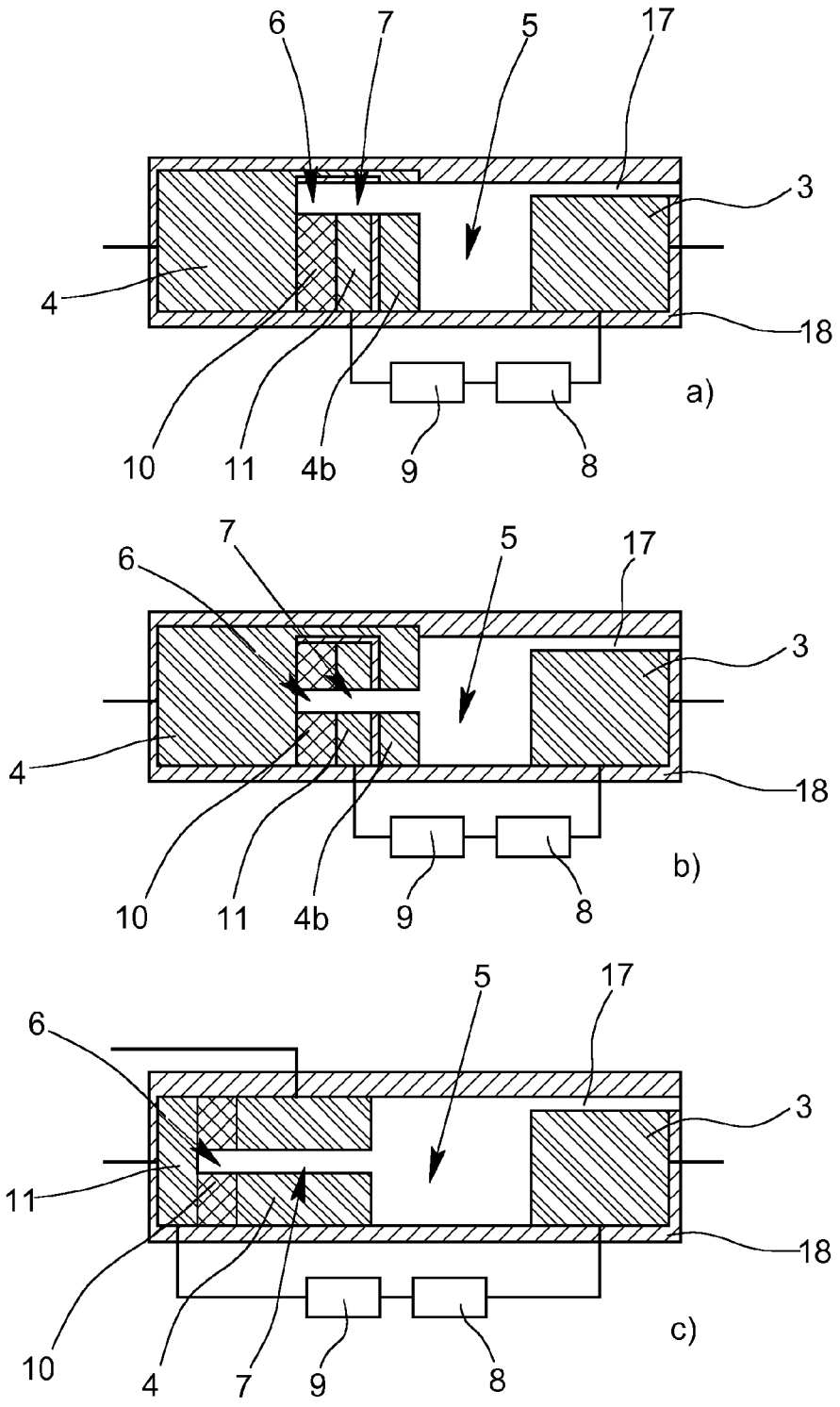
FIG. 4 shows three schematic sketches of other versions of a surge arrester and FIG. 5 shows schematic sketches of two versions of another exemplary embodiment of a surge arrester.

The schematic sketches shown in FIG. 4 show three different versions of the arrangement and the configuration of the ignition region 6, in particular of the spatial arrangement of the second main electrode 4 to the ignition element 10 and to the ignition electrode 11. Here the overall structure of the surge arrester 1, especially the configuration of the arcing chamber 5, is shown only very simplified. Fundamentally here the arcing chamber 5—similarly to as shown in FIGS. 1 and 3—could also be divided into several sections and the two main electrodes 3, 4 could be arranged concentrically to one another.

The two versions according to FIGS. 4*a* and 4*b* have a very simple structure of the surge arrester 1 since the two main electrodes 3, 4 can easily make contact axially, i.e. the connection regions 3*a*, 4*a* can be routed out of the housing 2 simply on the face sides. The version according to FIG. 4*b* moreover has the advantage that the arrangement of the ignition element 10 and the ignition electrode 11 in the housing 2 is rotationally symmetrical. So that in the two versions according to FIGS. 4*a* and 4*b* the ignition element 10 and the ignition electrode 11 are not directly in contact with the arcing chamber 5, but only via the feed channel 7, the second main electrode 4 has a section 4*b* which from the viewpoint of the first main electrode 3 is located upstream of the ignition element 10 and the ignition electrode 11. The second main electrode 4 thus has a recess within which the ignition element 10 and the ignition electrode 11 are located, the ignition electrode 11 being insulated relative to the main electrode 4.

In the version according to FIG. 4*c*, the formation of this recess within the main electrode 4 can be omitted since the second main electrode 4 is located altogether—from the viewpoint of the first main electrode 3—in front of the ignition element 10 and the ignition electrode 11. This simpler configuration of the second main electrode 4 however leads to the second main electrode 4 no longer making contact axially from one face side of the housing 2, but radially. Alternatively the contact-making of the second main electrode can also take place via the housing. In this case, then, the other potentials, therefore the first main electrode and the ignition electrode, must be insulated relative to the housing.

It is common to all the embodiments shown in FIG. 4 that the ignition element 10 is connected, not directly, but via the feed channel 7 to the arcing chamber 5 so that the ignition element 10 after the ignition of the spark gap between the main electrodes 3, 4 does not touch the hot gases which are formed by the impending arc. Moreover it is common to all three versions that the ionized gas which is produced in the ignition region 6 when the ignition aid operates can flow out only in one direction, specifically in the direction of the arcing chamber 5, the ionized gas due to the small cross section of the feed channel 7 flowing with high velocity into the arcing chamber 5 so that ignition of the spark gap between the two main electrodes 3, 4 occurs relatively promptly.

Figure 5:
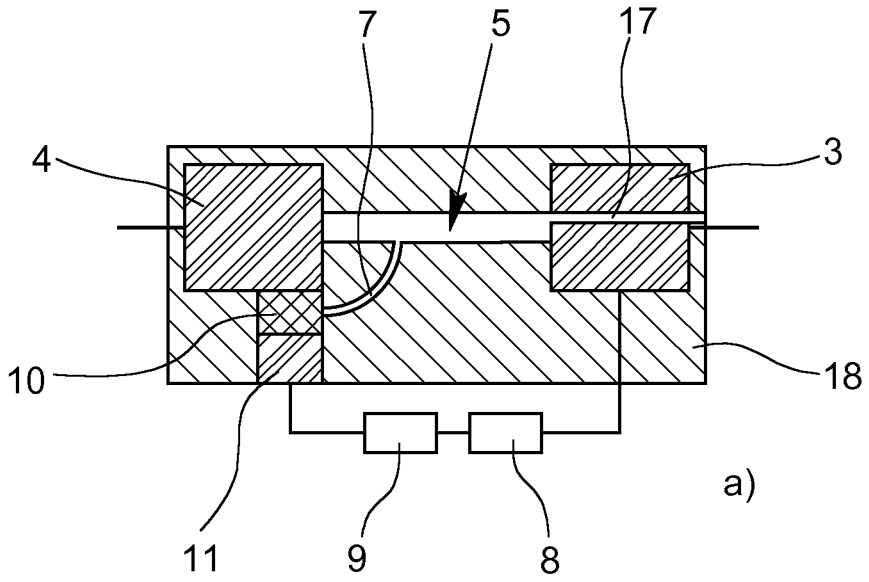
Figure 5:
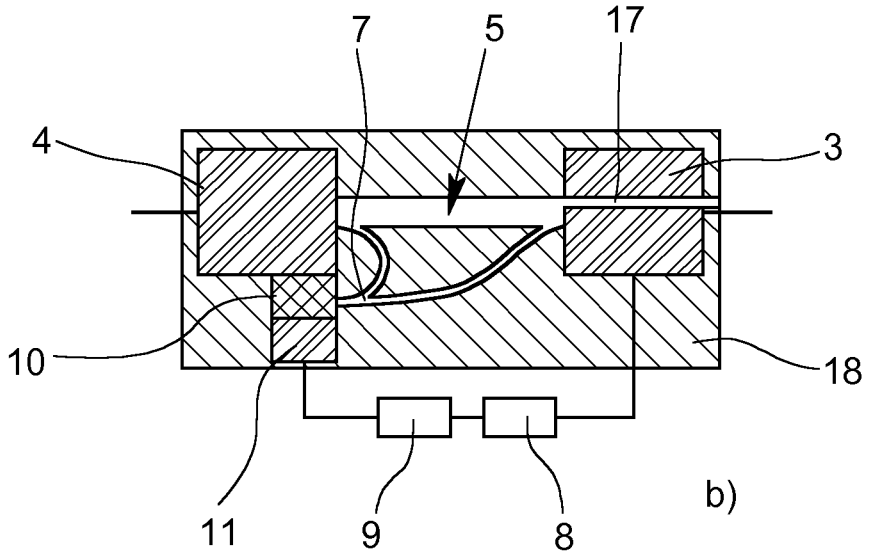

The schematic sketches of FIG. 5 show two other versions of the possible arrangement of the ignition element 10 and the ignition electrode 11 relative to the assigned second main electrode 4. In this case the ignition element 10 is located laterally next to the main electrode 4 so that the ignition region 6 is also laterally offset to the arcing chamber 5. Depending on the configuration of the feed channel 7, in this way the ionized gas can be delivered into the arcing chamber 5 at a certain site. As is apparent from FIG. 5*b*, several feed channels 7 can also be formed so that the ionized gas which forms in the ignition region 6 can be delivered into the arcing chamber 5 at different locations. In addition to the arrangement of an ignition element 10 and an ignition electrode 11 only on one side of the second main electrode 4, a rotationally-symmetrical structure can also be implemented, for example by the use of an annular ignition element 10 and an annular ignition electrode 11, and then several feed channels 7 can be easily formed in a radially distributed manner.

What is claimed is:

1. A surge arrester for use in the power supply of low voltage systems, comprising:

a housing, two main electrodes which form a spark gap within the housing, arcing chamber within the housing between the two main electrode, and an ignition aid which produces ionized gas in an ignition region that spreads in the arcing chamber so that the spark gap ignites between the two main electrodes and an arc arises in the arcing chamber, wherein at least one feed channel is formed between the ignition aid and the arcing chamber by which the ionized gas in the ignition region flows into the arcing chamber wherein the ignition aid has an ignition circuit and a resistive ignition element, the ignition element being connected to the feed channel and being electrically connected on one side via the ignition circuit to the first main electrode and on another side touches the second main electrode so that, after ignition of the ignition circuit, a current flows from the first main electrode via the ignition element to the second main electrode.

2. The surge arrester as claimed in claim 1, wherein the ignition aid has an ignition electrode which is located on the side of the ignition element opposite the second main electrode.

3. The surge arrester as claimed in claim 1, wherein the feed channel is free of corners and edges, such that the ionized gas in the ignition region is able to flow with high velocity into the arcing chamber.

4. The surge arrester as claimed in claim 3, wherein the feed channel is formed, at least in sections, as a nozzle.

5. The surge arrester as claimed in claim 1, wherein the at least one feed channel is surrounded by at least one insulation body, the at least one insulation body being formed of a hard-gassing or non-gassing material.

6. The surge arrester as claimed in claim 1, wherein the at least one feed channel is surrounded by several interconnected insulation bodies, some of which are formed a gassing material and some of which are formed of a non-gassing material.

7. The surge arrester as claimed in claim 1, wherein the at least one feed channel discharges into the arcing chamber such that the ionized gas which has been produced in the ignition region is distributed as uniformly as possible in the arcing chamber.

8. The surge arrester as claimed in claim 1, wherein that at least one feed channel is several feed channels which discharge into different regions of the arcing chamber.

9. The surge arrester as claimed in claim 1, wherein the two main electrodes are arranged concentrically relative to one another such that one main electrode surrounds the other main electrode at least in a region of the arcing chamber with a radial distance between the main electrodes.

10. The surge arrester as claimed in claim 9, wherein the arcing chamber as several individual sections which are parallel to one another and which each extend between the two main electrodes, the individual sections being connected to one another bordering the two main electrodes via axially extending channels.

11. The surge arrester as claimed in claim 10, wherein each of the sections of the arcing chamber into which the at least one feed channel discharges has a smaller volume than the other sections of the arcing chamber.

12. The surge arrester as claimed in claim 1, wherein on a side of the arcing chamber facing away from the feed channel, at least one outflow channel is formed via which ionized gas is able to flow out of the arcing chamber, the outflow channel being guided along the first main electrode.

13. The surge arrester as claimed in claim 1, wherein the housing is made essentially rotationally symmetrical and is made of steel or plastic.

* * * * *